United States Patent [19]

Ofusa

[11] Patent Number: 4,597,418

[45] Date of Patent: Jul. 1, 1986

[54] WOVEN SLIDE FASTENER

[75] Inventor: Masaatsu Ofusa, Toyama, Japan

[73] Assignee: Yoshida Kogyo K. K., Tokyo, Japan

[21] Appl. No.: 669,771

[22] Filed: Nov. 9, 1984

[30] Foreign Application Priority Data

Nov. 28, 1983 [JP] Japan ..... 58-183414
Nov. 28, 1983 [JP] Japan ..... 58-183415
Dec. 12, 1983 [JP] Japan ..... 58-191280

[51] Int. Cl.[4] ..... D03D 1/00; A44B 19/34
[52] U.S. Cl. ..... 139/384 B; 24/392
[58] Field of Search ..... 139/384 B; 24/392, 393

[56] References Cited

U.S. PATENT DOCUMENTS 3,524,479 8/1970 Burbank ..... 139/384 B
3,961,652 6/1976 Hasuda et al. ..... 139/384 B
4,191,220 3/1980 Yoshida ..... 139/384 B
4,210,180 7/1980 Tsubata ..... 139/384 B
4,383,558 5/1983 Tsubata et al. ..... 139/384 B

*Primary Examiner*—James Kee Chi
*Attorney, Agent, or Firm*—Hill, Van Santen, Steadman & Simpson

[57] ABSTRACT

Disclosed is a woven slide fastener of the type in which fastener elements formed of a continuous monofilament in the shape of a coil are woven into a longitudinal side portion of a tape fabric at the same time that the tape fabric is woven. In order to improve element spacing stability and raise the bending and tensile strength, as well as the thrust-up strength, of a fastener chain, a weft thread at an element weave-in portion of the tape is so arranged as to alternately run over and under and intersect binding warp threads and coil-fastening warp threads.

4 Claims, 4 Drawing Figures

WOVEN SLIDE FASTENER

BACKGROUND OF THE INVENTION

1. Field of the Invention

This invention relates to a woven slide fastener of the type in which fastener elements formed of a continuous monofilament in the shape of a coil are woven into a longitudinal side portion of a tape fabric at the same time that the tape fabric is woven. Hereafter, the fastener elements shall be referred to simply as "elements".

2. Description of the Prior Art

In the prior art, the coil-shaped elements of the woven slide fastener of the foregoing type are woven into the tape fabric under a condition in which the continuous monofilament, which is much thicker and sturdier than the weft and warp threads of the fabric, is bent into a coil-shaped configuration. Consequently, the fastener chain tends to stretch or elongate in the longitudinal direction and the coil loops tend to become skewed. More specifically, stability of coil spacing and the desirable upstanding attitude of the coil loops are difficult to maintain merely by weaving the elements into a longitudinal side edge of the tape fabric. Various attemps have been made to improve upon this problem. In one arrangement, such as disclosed in the specification of Japanese Patent Publication No. 46-7018, the warp threads at portions where the elements are woven are arrayed more densely than the warp threads constituting the main body of the tape fabric. While this arrangement prevents collapse of the coil loops, longitudinal expansion and contraction of the fastener chain cannot be prevented, and the problem of element spacing stability remains unsolved. Further, as disclosed in the specification of Japanese Patent Application Laid-Open No. 56-60504, a binding warp thread is so arrayed as to run astride the tops of two elements and pass below a foundation weft thread between these two elements, thereby forming double weft threads arranged between the elements into a loop and disposing the weft threads as a pad between upper and lower leg portions of the elements. This enhances element resistance against twisting and skewing to improve spacing stability. However, since the binding warp threads are clustered by the weft threads, the fastener chain is increased in thickness and loses pliability.

SUMMARY OF THE INVENTION

A first object of the present invention is to improve upon the foregoing defects and provide a woven slide fastener in which coils loops are maintained in a correct upstanding attitude and coil spacing stability is enhanced without any loss of fastener chain pliability, by virtue of which the woven slide fastener may form a fastener chain of improved bending and tensile strength as well as enhanced strength with respect to thrust-up.

According to the present invention, the first object is attained by providing a woven slide fastener in which there are arranged upper binding warp threads 2 extending substantially linearly along the upper surface of upper leg portions c of the elements, lower binding warp threads 3 extending substantially linearly along the lower surface of lower leg portions d of the elements, coil-fastening warp threads 6 disposed between the binding warp threads, and weft threads 4 extending from the tape proper to the longitudinal edge portion thereof where the elements are woven, the weft threads 4 passing alternately over and under the binding warp threads and coil-fastening warp threads 6, whereby the coil loops are held in a correct upstanding attitude and the coil spacing stability is improved.

A second object of the present invention is to provide a woven slide fastener so adapted as to strengthen the ability to hold coupling head portions in a correct attitude important for achieving coupling.

The second object of the invention is attained by adding the following features to the above-described construction by which the first object is attained. Specifically, gap-closing warp threads, 7, 7', 7'' are arranged at the edge portion of the tape on the longitudinal side thereof where the elements are woven, with the gap-closing warp threads being disposed on the coupling head sides of the elements.

A third object of the invention is to provide a woven slide fastener in which the ability to hold coupling head portions in a correct attitude important for achieving coupling is strengthened, and in which weaving stability at the time that the elements are woven into the tape fabric is enhanced.

The third object of the invention is attained by adding the following features to the above-described construction by which the first object is attained. Specifically, a gap-closing warp thread 8 is arranged at the edge portion of the tape on the longitudinal side thereof where the elements are woven, and the aforementioned weft threads 4 are wound around the gap-closing thread 8 to close the gap between mutually adjacent coupling head portions of the elements.

The above and other objects, features and advantages of the invention will be more apparent from the ensuing detailed description taken in connection with the accompanying drawings.

DETAILED DESCRIPTION OF THE PREFERRED EMBODIMENT

Figure 1:
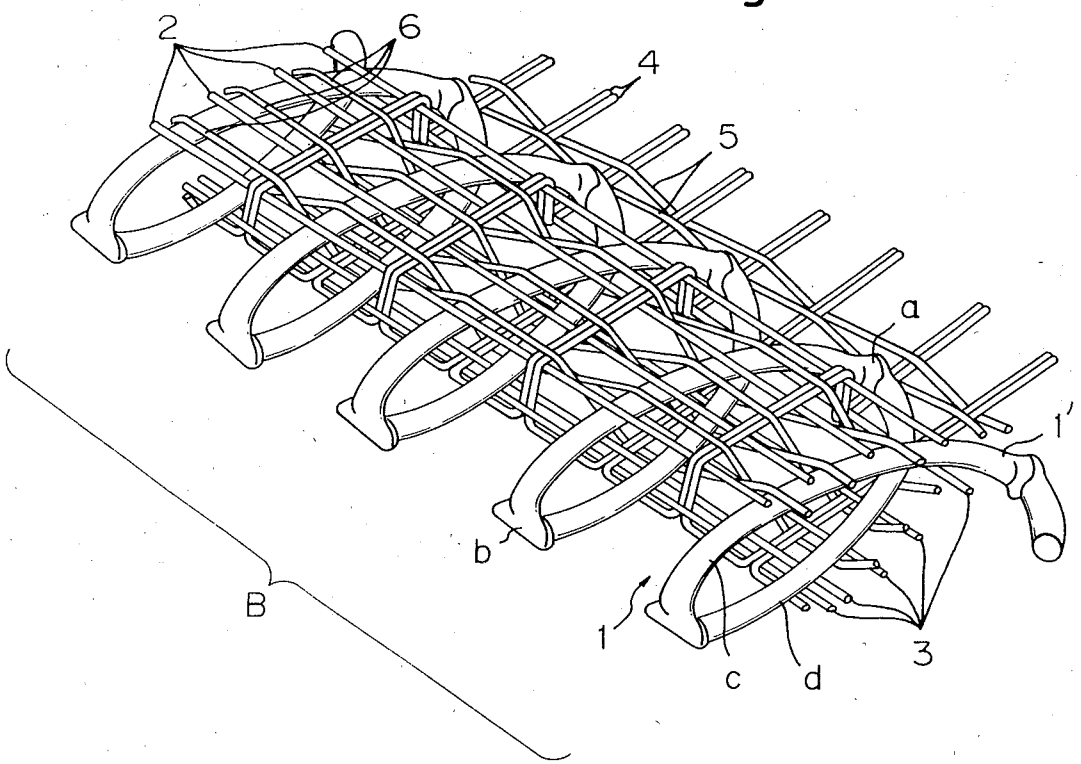
FIG. 1 is a perspective view illustrating a principal portion of a first embodiment.

FIG. 1 is a perspective view illustrating a principal portion of a woven slide fastener according to a first embodiment of the present invention. The woven slide fastener is formed by molding elements which describe coilshaped loops consisting of a continuous, synthetic resin monofilament while the continuous monofilament is inserted in double picks, and weaving the elements into a longitudinal side portion of a fastener tape at the same time that the tape is woven. A flat coil 1 comprises a continuous monofilament 1', which has been deformed under pressure at regular intervals, and is produced by winding the monofilament 1' into a coil while the monofilament is bent at the deformed portions to form heel portions a and coupling head portions b. Each element unit is connected at its ends, namely at its heel portions a, with an element unit at either side thereof to construct an element row B forming the flat coil. Upper binding warp threads 2 extend substantially linearly along the upper sides of upper leg portions c of the elements, and coil-fastening warp threads 6 are arrayed alternately between the upper binding warp threads 2. Lower binding warp threads 3 extend substantially linearly along the lower sides of lower leg portions d of the elements, and the coil-fastening warp threads 6 are alternately arrayed between the lower binding warp threads 3 just as described in connection with the upper binding warp threads. Numeral 4 denotes a weft thread, two of which form a single weft in order to be inserted in double picks by a needle-type weaving machine. The weft threads 4 are arranged in such a manner that loops are formed near the upper and lower leg portions of the elements by the upper and lower binding warp threads extending substantially linearly at the longitudinal edge portion where the elements are woven into the tape. These weft threads 4 are interlaced with warp threads 5 to weave the body of the tape fabric. When the weft threads 4 run across the elements on the upper leg side thereof, the upper binding warp threads 2 and coil-fastening warp threads 6 are alternately arrayed up and down in the form of a plain fabric structure. Likewise, when the weft threads 4 run across the elements on the lower leg side thereof, the lower binding warp threads 3 and coil-fastening warp threads 6 are alternately arrayed up and down in the form of a plain fabric structure. Though the upper and lower binding warp threads 2, 3 are illustrated as being perfectly linear, they actually run in a somewhat undulating pattern in the vertical direction owing to tension applied by the weft threads 4, but appear to extend substantially linearly when the fastener is viewed in its entirety. The warp thread 5 mentioned above weaves the tape fabric by being interlaced with the weft threads 4. The coil-fastening warp threads 6 are alternately arrayed in such a manner that one is disposed between mutually adjacent threads of the upper binding warp threads and one between mutually adjacent threads of the lower binding warp threads. The fastening weft threads 6 are woven in at 2/2 with respect to the weft thread 4 and at 1/1 with respect to the continuous monofilament 1', and are interlaced with the weft thread 4 and with the continuous monofilament 1' to weave in the flat coil 1 as a portion of the tape fabric.

In the first embodiment illustrated in FIG. 1, the slide fastener includes four of the upper binding warp threads, five of the lower binding warp threads 3, and six of the coil-fastening warp threads 6. However, the number of warp threads of each type may be increased or decreased depending upon the thickness, length and shape of the element leg portions.

According to the first embodiment of the present invention, upper binding warp threads extending substantially linearly longitudinally of a fastener chain are arranged along the upper and lower surfaces of upper and lower element leg portions, respectively. As a result, elongation of the fastener chain is reduced in comparison with the conventional arrangement in which the binding warp threads are woven in by interlacing them with the element leg portions in over-and-under fashion. Coil spacing is therefore stabilized to a great degree. Since a coil-fastening warp thread is alternately arranged between the binding warp threads, each coil loop is maintained in a correct upstanding attitude. Moreover, by virtue of the fact that a weft thread is arranged in the manner of a plain fabric structure above and below the binding warp threads and coil-fastening threads, shifting of the binding warp threads is prevented so that the warp threads on the leg portions of the elements can be arrayed further apart without overlapping one another. This makes it possible to retain the elements over a wide range. The ability to hold the coil loops in the correct upstanding attitude and the stability of the coil spacing are greatly enhanced, the bending and tensile strength and the thrust-up strength of the fastener chain are improved, and the fastener chain itself is rendered thin and flexible.

Figure 2:
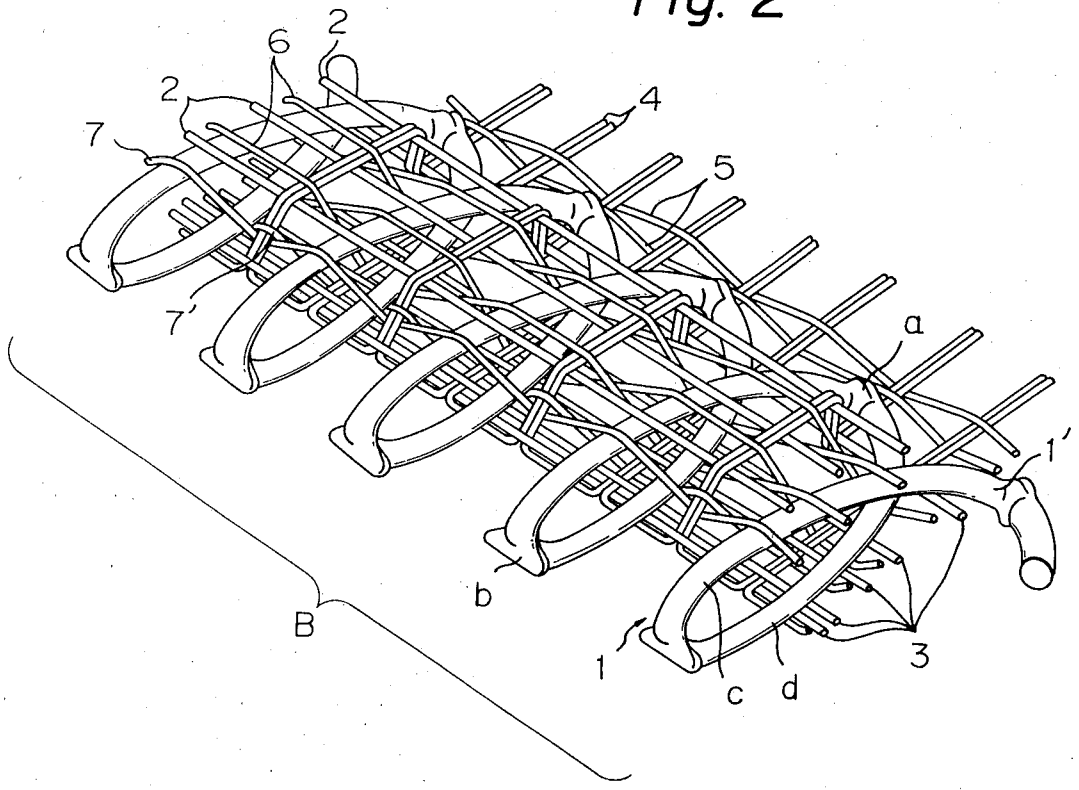
FIG. 2 is a perspective view illustrating a principal portion of a second embodiment.

FIG. 2 is a perspective view illustrating a principal portion of a woven slide fastener according to a second embodiment of the present invention, in which parts designated by numerals 1 through 6 correspond to those represented by like numerals in FIG. 1 and shall not be described again.

Numerals 7, 7' in FIG. 2 denote gap-closing warp threads. In order to fill and close gaps between the leg portions of neighboring elements on the longitudinal side portion of the tape where the coupling heads are located, the two warp threads 7, 7' are arranged to cross at these gaps and to interlace the weft threads 4.

Figure 3:
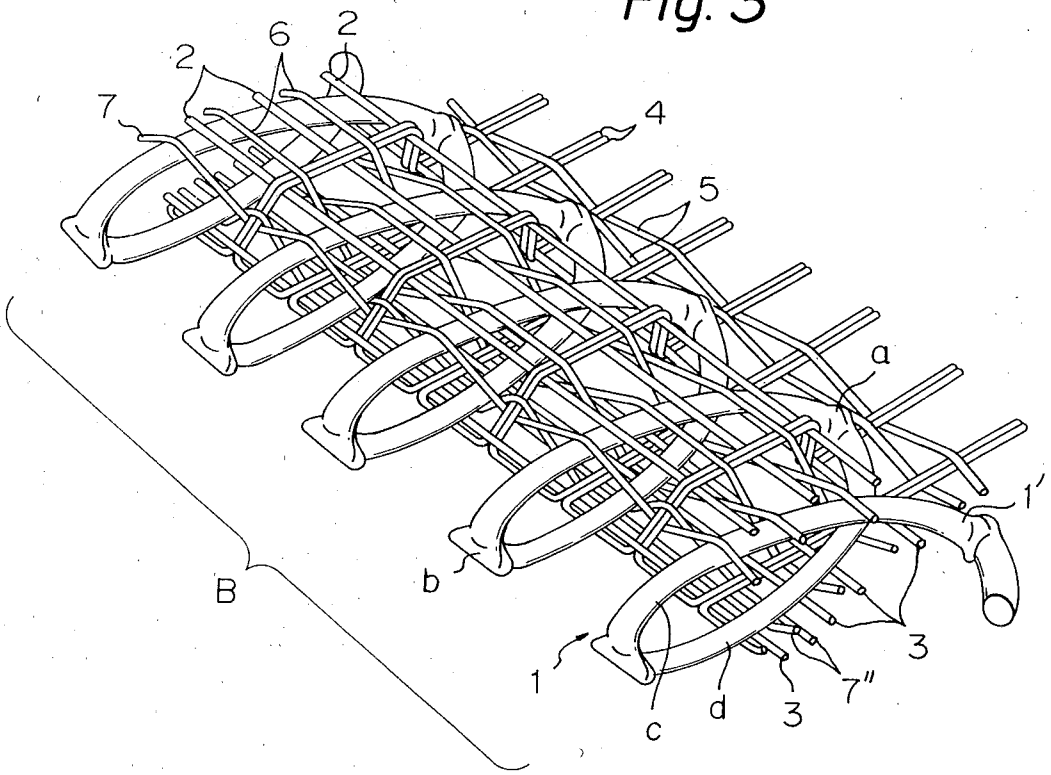
FIG. 3 is a perspective view illustrating a principal portion of a third embodiment.

FIG. 3 illustrates a third embodiment of the invention. Unlike the second embodiment of the invention shown in FIG. 2, one less lower binding warp 3 is provided, two warp threads 7'' are used in place of the single lower gap-closing warp thread 7', the two warp threads 7'' alternately cross the upper gap-closing warp thread 7 in the form of a $\frac{1}{3}$ structure and are interlaced with the weft threads 4, whereby the lower gap-closing warp threads 7'' are endowed with a coil-fastening action. The construction of the woven slide fastener is similar to that of the second embodiment in other respects.

The second and third embodiments of the present invention thus provide a more effective woven slide fastener in which the ability to maintain the coil loops in a correct upstanding attitude and the stability of coil spacing are vastly improved by providing binding warp threads extending substantially linearly longitudinally of a fastener chain, and arranging coil-fastening warp threads between the binding warp threads. Gap-closing warp threads are arranged to cross and flex at weft threads between neighboring element leg portions on the longitudinal side portion of the tape where the coupling heads are located. The gaps between the leg portions are therefore filled and closed to hold the coupling head portions in a normal attitude and facilitate fastener coupling. The upper and lower binding warp threads are prevented from slipping off the elements by the crossed gap-closing warp threads and weft threads. In particular, element holding force is enhanced by alternately zig-zagging the lower gap-closing warp threads across the two leg portions of the elements, and bending and tensile strength are improved on the reverse side of the fastener chain.

Figure 4:
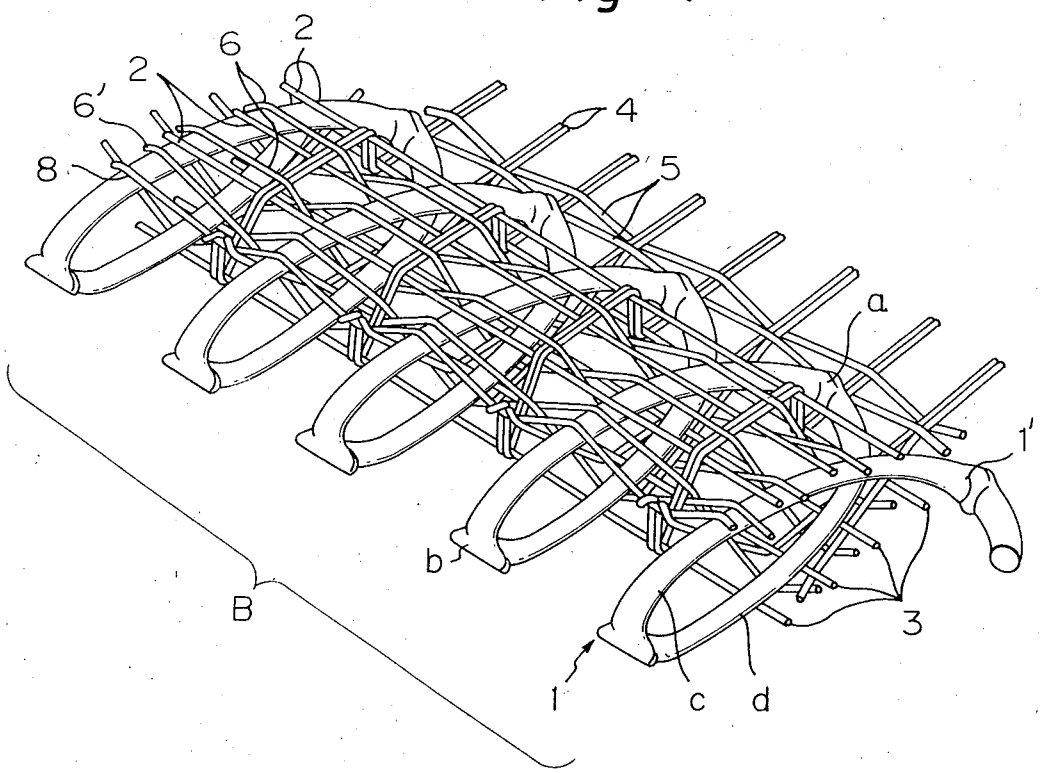
FIG. 4 is a perspective view illustrating a principal portion of a fourth embodiment.

FIG. 4 is a perspective view illustrating a principal portion of a woven slide fastener according to a fourth embodiment of the present invention. The woven slide fastener is formed by molding elements which describe coilshaped loops consisting of a continuous, synthetic resin monofilament while the continuous monofilament is inserted in double picks, and weaving the elements into a longitudinal side portion of a fastener tape at the same time that the tape is woven. Parts designated by numerals 1 through 6 correspond to those represented by like numerals in FIG. 1 and shall not be described again.

Numeral 6' in FIG. 4 denotes a second coil-fastening warp thread arranged between a gap-closing warp thread 8 and the upper binding warp thread 2. The weft threads 4 pass below the lower binding warp threads 3, so that the coil-fastening warp thread 6', unlike the other coil-fastening warp threads 6, crosses the weft threads 4 intermediate the upper and lower leg portions c, d in the gaps between the leg portions of neighboring elements. In order to fill and close the gaps between the leg portions of neighboring elements on the longitudinal side portion of the tape where the coupling heads are located, the weft threads 4, which have been inserted in double picks, are wound around the gap-closing warp thread 8 by being turned back.

The fourth embodiment of the present invention thus provides a more effective woven slide fastener in which the ability to maintain the coil loops in a correct upstanding attitude and the stability of coil spacing are vastly improved by providing binding warp threads extending substantially linearly longitudinally of a fastener chain, and arranging coil-fastening warp threads between the binding warp threads. A gap-closing warp thread is arranged to have weft threads wound thereon between neighboring element leg portions on the longitudinal side portion of the tape where the coupling heads are located. The gaps between the leg portions are therefore filled and closed to hold the coupling head portions in a normal attitude and facilitate fastener coupling. By winding the weft threads on the gap-closing warp threads, stitching stability at the time the elements are woven in is enhanced. Shifting of the gap-closing warp thread toward the tape fabric proper is prevented by the coil-fastening warp thread 6' arranged on the longitudinal side edge of the tape, thereby allowing the foregoing excellent effects to be maintained over a longer period of time.

As many apparently widely different embodiments of the present invention can be made without departing from the spirit ad scope thereof, it is to be understood that the invention is not limited to the specific embodiments thereof except as defined in the appended claims.

We claim:

1. A woven slide fastener having a tape fabric body, a continuous monofilament forming coil-shaped fastener elements and inserted in double picks in a longitudnal side edge of the tape fabric body, warp threads, and a weft thread extending continuously from the tape fabric body and woven together with the warp threads to form a unitary body, said woven slide fastener comprising a plurality of upper binding warp threads running substantially linearly along an upper side of upper leg portions of the fastener elements, a plurality of lower binding warp threads running substantially linearly along a lower side of lower leg portions of the fastener elements, said upper and lower warp threads being arranged in warp threads constituting an element weave-in portion, and coil-fastening warp threads disposed between the binding warp threads and arranged to span and interlace with the continuous monofilament and the weft thread extending from the tape fabric body to the element weave-in portion on upper and lower sides of the continuous monofilament forming the elements, said weft thread being arranged to alternately run over and under the binding warp threads and the coil-fastening warp threads on the side of the upper leg portions of the elements and on the side of the lower leg portions of the elements.

2. The woven slide fastener according to claim 1, further comprising gap-closing warp threads arranged in an edge portion of the element weave-in portion on the side of coupling heads and interlaced with said weft thread so as to close gaps between mutually adjacent coupling heads of the elements.

3. The woven slide fastener according to claim 1, further comprising a gap-closing warp thread arranged at an edge of the element weave-in portion on the side of coupling heads of the elements, said weft thread being wound around said gap-closing thread to close gaps between mutually adjacent coupling heads of the elements.

4. The woven slide fastener according to claim 3, wherein those coil-fastening warp threads nearest to said gap-closing warp thread interlace with the weft thread intermediate the upper and lower leg portions of each element.

* * * * *